US010883218B2

(12) United States Patent
Kim et al.

(10) Patent No.: US 10,883,218 B2
(45) Date of Patent: Jan. 5, 2021

(54) LAUNDRY TREATMENT MACHINE

(71) Applicant: LG ELECTRONICS INC., Seoul (KR)

(72) Inventors: Hyunjin Kim, Seoul (KR); Changwoo Son, Seoul (KR); Minho Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 216 days.

(21) Appl. No.: 15/165,840

(22) Filed: May 26, 2016

(65) Prior Publication Data

US 2016/0348296 A1 Dec. 1, 2016

(30) Foreign Application Priority Data

May 28, 2015 (KR) ..... 10-2015-0075205

(51) Int. Cl.

| | |
|---|---|
| ***D06F 37/40*** | (2006.01) |
| ***D06F 13/02*** | (2006.01) |
| ***D06F 17/08*** | (2006.01) |
| ***D06F 34/18*** | (2020.01) |

(52) U.S. Cl.

CPC ..... *D06F 37/40* (2013.01); *D06F 13/02* (2013.01); *D06F 17/08* (2013.01); *D06F 34/18* (2020.02)

(58) Field of Classification Search

CPC ..... D06F 37/40; D06F 33/02

See application file for complete search history.

(56) References Cited

U.S. PATENT DOCUMENTS

| | | | | |
|---|---|---|---|---|
| 2003/0034054 | A1 | 2/2003 | Lee et al. | |
| 2003/0208855 | A1* | 11/2003 | McAllister | D06F 35/006 8/159 |
| 2007/0107139 | A1* | 5/2007 | Kee | D06F 35/006 8/158 |
| 2013/0181649 | A1* | 7/2013 | Jang | D06F 33/00 318/445 |

(Continued)

FOREIGN PATENT DOCUMENTS

| | | |
|---|---|---|
| EP | 2 354 296 | 8/2011 |
| KR | 10-0421868 | 1/2003 |

(Continued)

OTHER PUBLICATIONS

European Search Report dated Oct. 4, 2016 issued in Application No. 16171129.6.

(Continued)

*Primary Examiner* — Spencer E Bell

(74) *Attorney, Agent, or Firm* — KED & Associates LLP

(57) ABSTRACT

A laundry treatment machine includes a wash tub, a pulsator provided inside the wash tub and to be rotated, a motor to rotate at least one of the wash tub and the pulsator, a clutch to selectively transmit torque of the motor to at least one of the wash tub and the pulsator, a clutch drive unit to control driving of the clutch unit, and a controller to control the motor to repeat rotation and braking in a first direction a first number of times during a first time period after operation of the clutch is changed. With this configuration, in the top-loading type laundry treatment machine, the coupling force of the clutch may be increased when operation of the clutch is changed.

17 Claims, 12 Drawing Sheets

(56) References Cited

U.S. PATENT DOCUMENTS

| | | | | |
|---|---|---|---|---|
| 2014/0101865 | A1* | 4/2014 | Jang | D06F 39/003 8/137 |
| 2014/0115792 | A1* | 5/2014 | Lee | D06F 37/203 8/137 |
| 2018/0080158 | A1* | 3/2018 | Mamiya | D06F 33/00 |

FOREIGN PATENT DOCUMENTS

| | | |
|---|---|---|
| KR | 10-2004-0095453 | 11/2004 |
| KR | 10-2012-0130613 | 12/2012 |
| KR | 10-2015-0053556 | 5/2015 |
| WO | WO 2012/128567 | 9/2012 |

OTHER PUBLICATIONS

Korean Office Action dated Jun. 20, 2016 issued in Application No. 10-2015-0075205.

* cited by examiner

LAUNDRY TREATMENT MACHINE

CROSS-REFERENCE TO RELATED APPLICATION(S)

This application claims the priority under 35 U.S.C. § 119 to Korean Application No. 10-2015-0075205, filed 28 May 2015, the subject matter of which is hereby incorporated by reference in its entirety.

BACKGROUND

1. Field

The present disclosure relates to a laundry treatment machine and, more particularly, to a top-loading type laundry treatment machine which is capable of increasing the coupling force of a clutch when the operation of the clutch is changed.

2. Background

A laundry treatment machine may wash laundry using friction between the laundry and a wash tub which is rotated upon receiving driving power from a motor. Laundry, wash water, and detergent may be introduced into the wash tub, thereby causing substantially no damage to the laundry and preventing laundry from becoming tangled.

A top-loading type laundry treatment machine may include a wash tub and a pulsator rotatably provided on the bottom of the wash tub. In order to rotate only the wash tub or to rotate both the wash tub and the pulsator, a clutch may be used to selectively couple the wash tub and the pulsator to each other.

BRIEF DESCRIPTION OF THE DRAWINGS

The embodiments will be described in detail with reference to the following drawings in which like reference numerals refer to like elements, and wherein.

DETAILED DESCRIPTION

Figure 1:
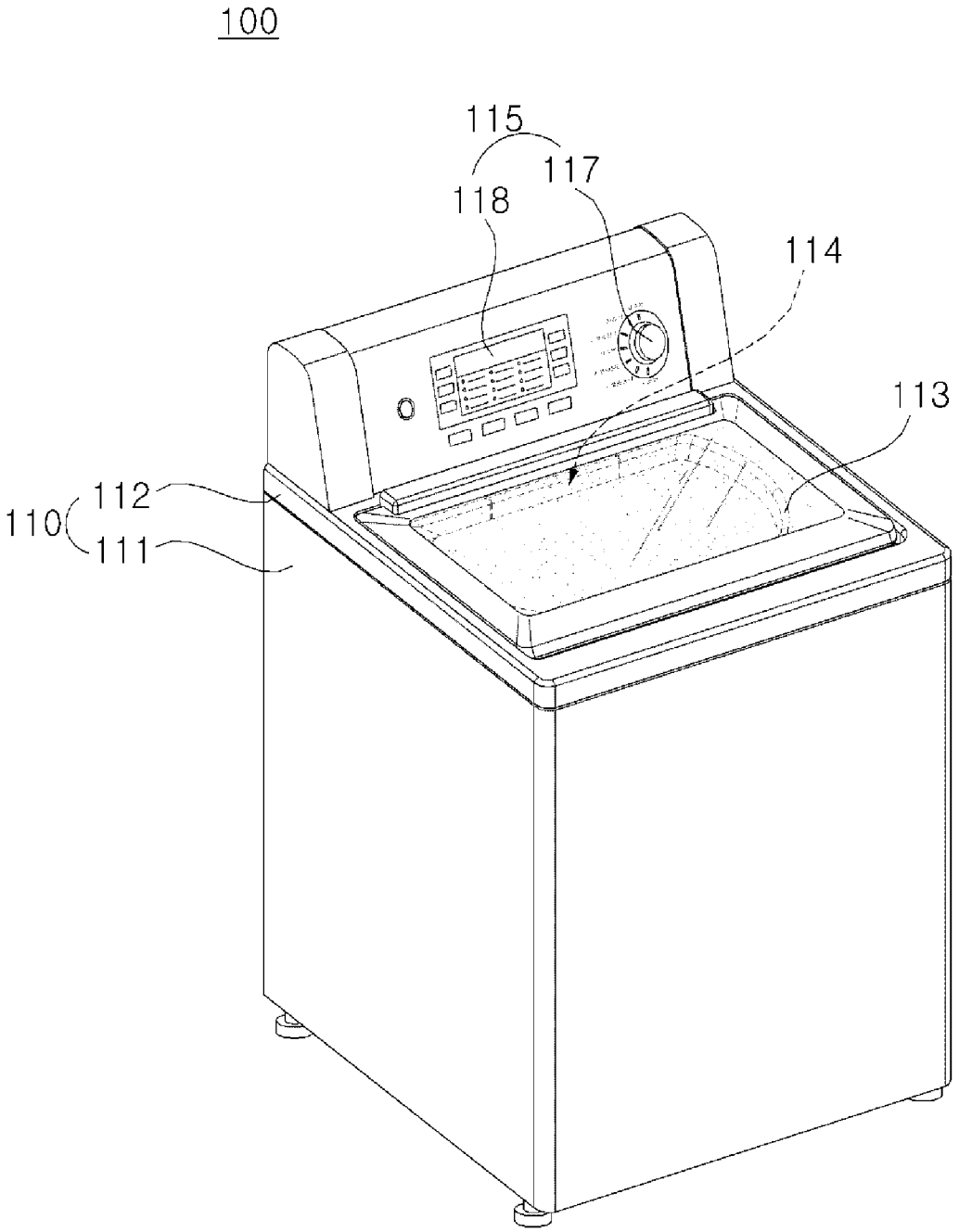
FIG. 1 is a perspective view illustrating a laundry treatment machine in accordance with one embodiment.
Figure 2:
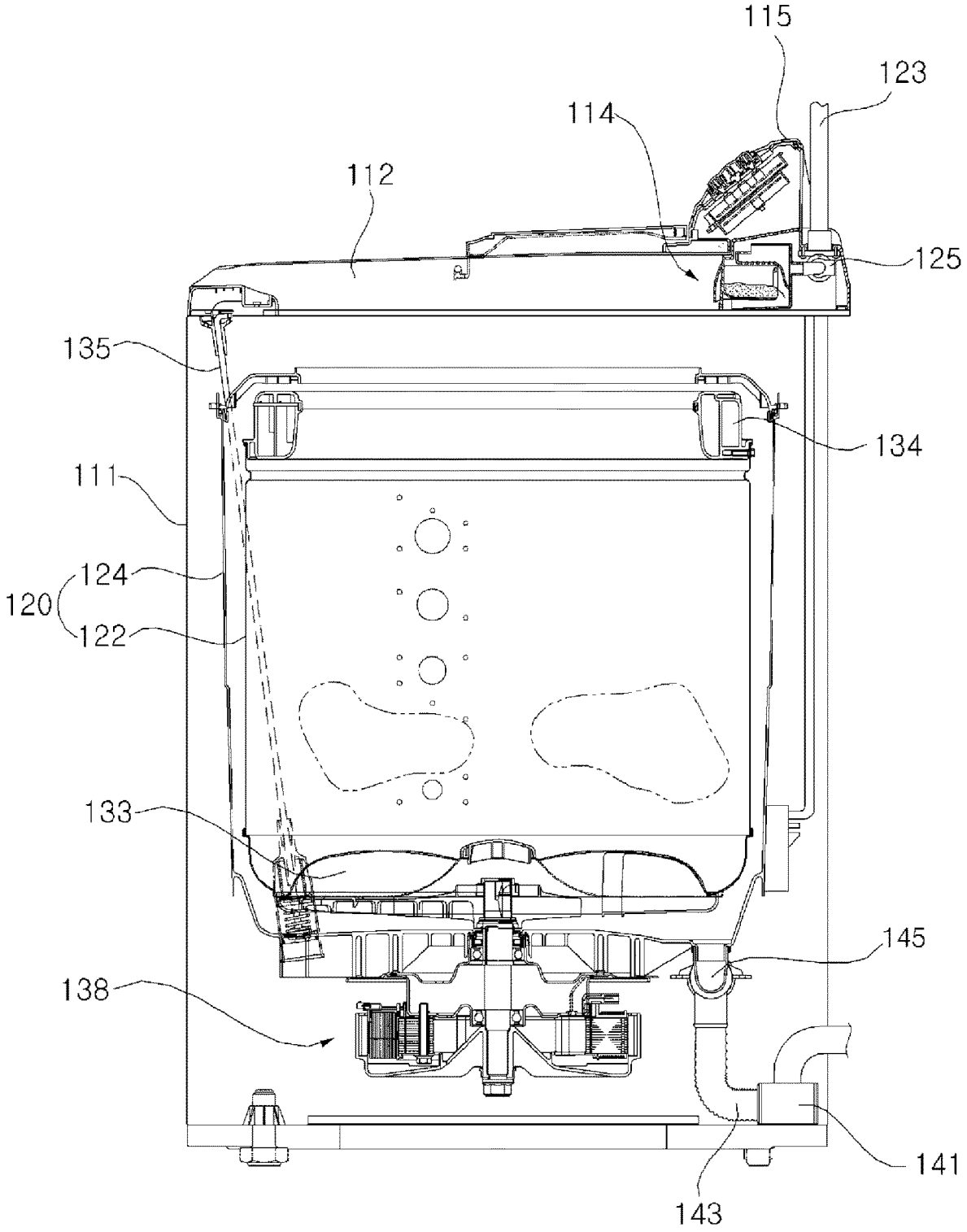
FIG. 2 is a side sectional view of the laundry treatment machine of FIG. 1.

Referring to FIGS. 1 and 2, the laundry treatment machine 100 may be a top-loading type laundry treatment machine in which fabric is inserted into a wash tub from the top. Such a top-loading type laundry treatment machine may perform washing, rinsing, and dehydration of fabric introduced thereinto, or may perform drying of wet fabric introduced thereinto.

The laundry treatment machine 100 may include a casing 110, which defines the external appearance of the machine, a control panel 115, which may include operating keys configured to receive a variety of control instructions from a user and a display configured to display information regarding the state of operation of the laundry treatment machine 100, thereby providing a user interface, and a door 113, which may be rotatably provided at the casing 110 and may be configured to open or close a laundry opening for the introduction or discharge of laundry. The casing 110 may include a main body 111, which defines the space in which various constituent elements of the laundry treatment machine 100 may be accommodated, and a top cover 112, which is provided at the top of the main body 111 and has the laundry opening through which laundry may be introduced into an inner tub 122.

Although the casing 110 has been described above as including the main body 111 and the top cover 112, it may be sufficient for the casing 110 to define the external appearance of the laundry treatment machine 100, and the casing 110 is not limited to the configuration described above. Although a support rod 135 will be described below as being coupled to the top cover 112, which is one of the constituent elements of the casing 110, the present embodiment is not limited thereto, and the support rod 135 may be coupled to any stationary portion of the casing 110.

The control panel 115 may include operating keys 117, which may be used to control the state of operation of the laundry treatment machine 100, and a display 118, which may be located to one side of the operating keys 117 and may display the state of operation of the laundry treatment machine 100. The door 113 may serve to open or close the laundry opening formed in the top cover 112, and may include a transparent member such as a piece of tempered glass, in order to allow the interior of the main body 111 to be visible.

The laundry treatment machine 100 may include a wash tub 120. The wash tub 120 may include an outer tub 124 in which wash water is poured, and an inner tub 122, which may be rotatably provided inside the outer tub 124 and in which laundry may be accommodated. A balancer 134 may be provided in the top region of the wash tub 120 to compensate for eccentricity which may occur when the wash tub 120 is rotated. The laundry treatment machine 100 may also include a pulsator 133, which is rotatably provided in the bottom region of the wash tub 120.

A power transmission device 138 may serve to provide driving power required to rotate the inner tub 122 and/or the pulsator 133. Clutches (320*a* and 320*b* in FIG. 4) may selectively transmit the driving power of the power transmission device 138 so that only the inner tub 122 is rotated, only the pulsator 133 is rotated, or both the inner tub 122 and the pulsator 133 are simultaneously rotated. The power transmission device 138 may be operated by a motor drive unit 220 and a clutch drive unit 620 of FIG. 8.

A detergent box 114, in which various additives such as washing detergent, fabric softener, and/or a bleaching agent may be accommodated, may be installed in the top cover 112 to be pulled out from or pushed into the top cover 112. Wash water, supplied through a water supply path 123, may be supplied into the inner tub 122 by way of the detergent box 114.

The inner tub 122 may be formed with a plurality of holes so that the wash water supplied into the inner tub 122 moves to the outer tub 124 through the holes. A water supply valve 125 may be provided to control the water supply path 123.

The wash water may be discharged from the outer tub 124 through a drain path 143. A drain valve 145 may be provided to control the drain path 143, and a drain pump 141 may be provided to pump the wash water.

The support rod 135 may serve to hang the outer tub 124 within the casing 110. A first end of the support rod 135 may be connected to the casing 110 and a second end of the support rod 135 may be connected to the outer tub 124 via a suspension.

The suspension may serve to absorb vibrations of the outer tub 124 during the operation of the laundry treatment machine 100. The outer tub 124 may vibrate due to vibrations generated as the inner tub 122 is rotated, and the suspension may alleviate vibrations caused by various factors such as the eccentricity of laundry accommodated in the inner tub 122 and the rotational speed or resonance characteristic of the inner tub 122 while the inner tub 122 is rotated.

Figure 3:
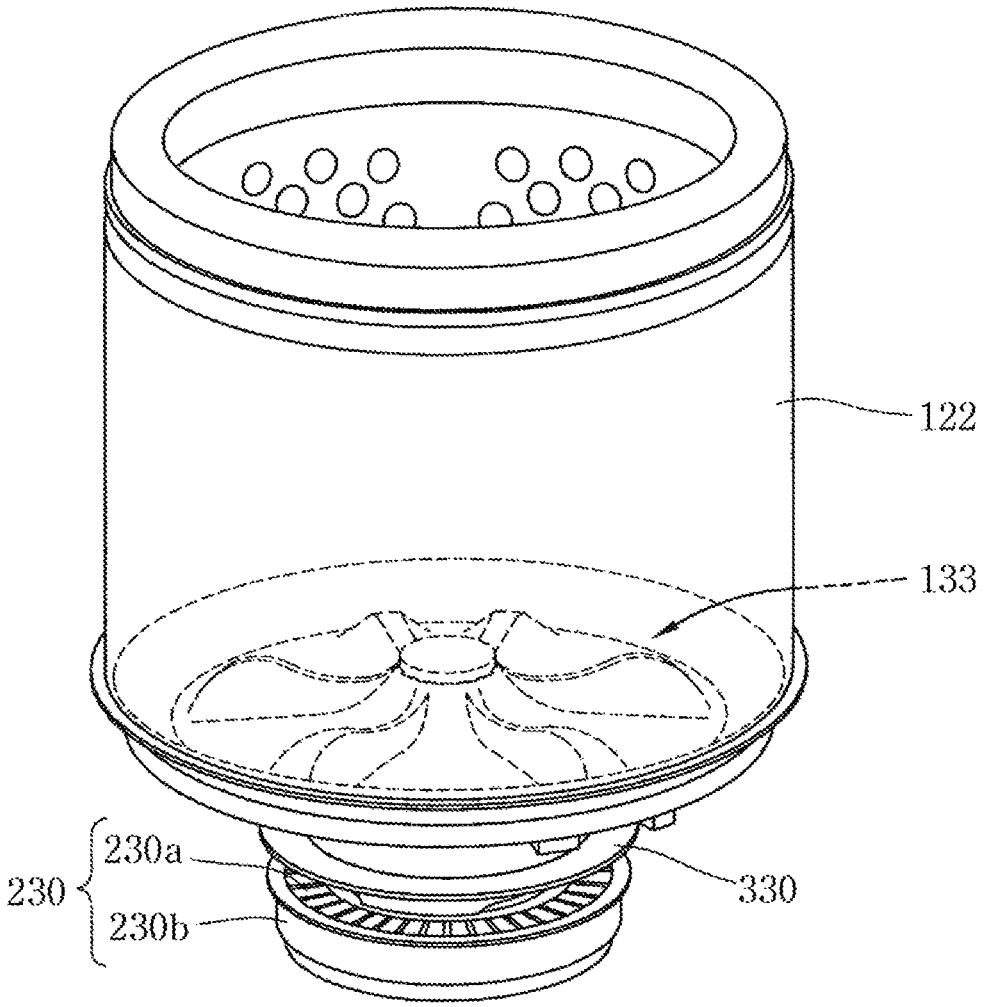
FIG. 3 is a perspective view illustrating an inner tub and a drive motor of FIG. 2.

Referring to FIG. 3, the inner tub 122 may be mounted inside the outer tub 124. The pulsator 133 may be rotatably installed on the bottom surface of the inner tub 122. In addition, a bearing housing 330, in which a bearing configured to rotatably support the inner tub 122 is mounted, may be located below the inner tub 122, and a motor 230 may be provided on the underside of the bearing housing 330.

Driving power generated by the motor 230 may be transmitted to enable the rotation of the inner tub 122 and the pulsator 133. Specifically, a stator 230*a* may be provided within the motor 230 and a rotator 230*b* may be provided around the stator 230*a*. The rotator 230*b* may be coupled to the motor drive unit 220.

Figure 4:
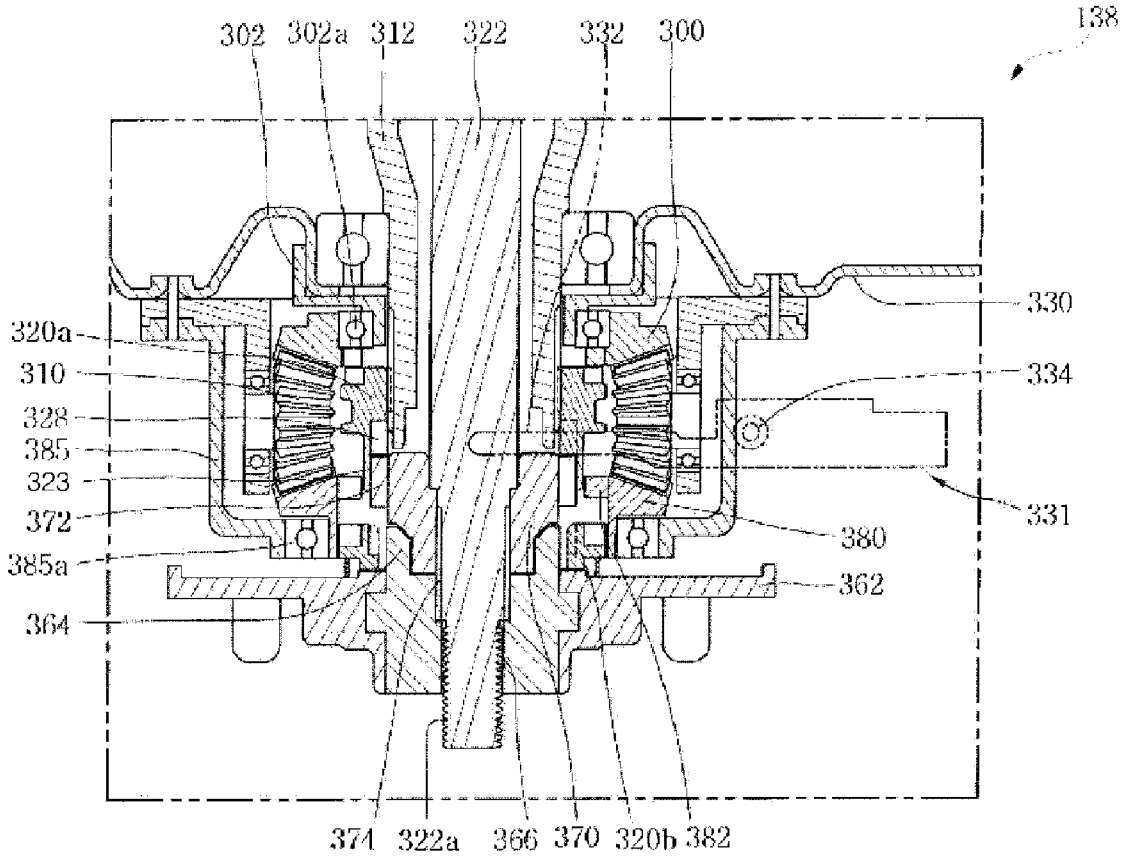
FIG. 4 is a sectional view illustrating a power transmission device of FIG. 2 in detail.
Figure 5:
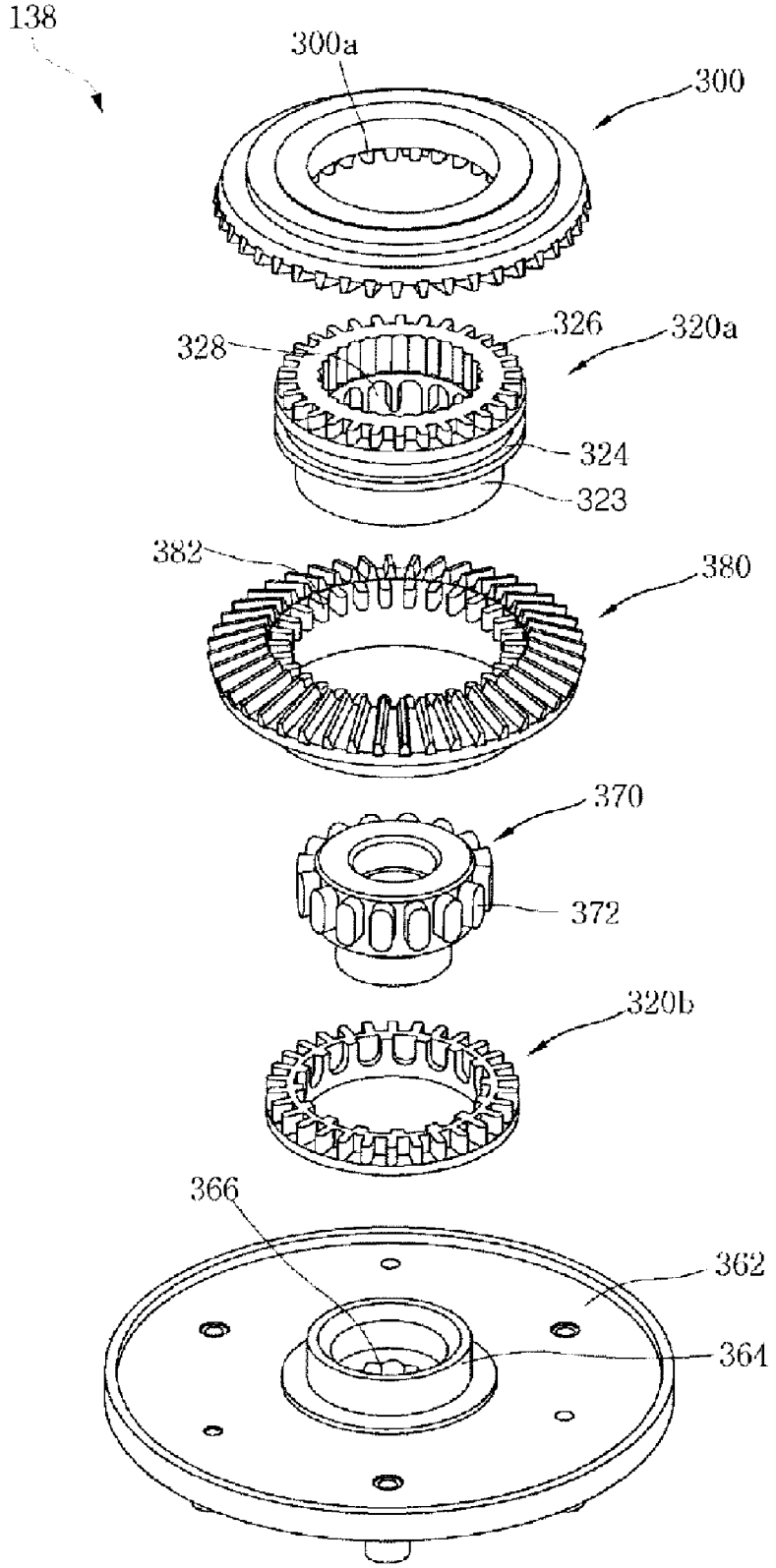
FIG. 5 is an exploded perspective view illustrating respective constituent elements of the power transmission device of FIG. 4.

Referring to FIGS. 4 and 5, the inner tub 122 may be coupled to and rotated along with a first rotating shaft 312, and the pulsator 133 may be coupled to and rotated along with a second rotating shaft 322. Here, the first rotating shaft 312 may have a hollow shape, and the second rotating shaft 322 may be concentrically located inside the first rotating shaft 312. The first rotating shaft 312 may be referred to as a dehydration shaft, and the second rotating shaft 322 may be referred to as a washing shaft.

The second rotating shaft 322 may be coupled to the rotator 230*b*. The second rotating shaft 322 may be fixed to penetrate the center of a shaft fixing plate 362, which may be secured to the inner surface of the rotator 230*b*.

Screw threads 322*a* may be formed around the lower end of the second rotating shaft 322, and a fixing nut may be fastened to the screw threads 322*a* from the lower surface of the rotator 230*b*, to cause the second rotating shaft 322 to be rotated along with the shaft fixing plate 362. The shaft fixing plate 362 may have a disc shape as illustrated in FIG. 5, and may be centrally provided with a boss member (or boss) 364.

A gear portion 366 may be formed on the lower portion of the inner circumferential surface of the boss member 364 and may be engaged with a gear portion formed on the outer circumferential surface of the second rotating shaft 322. Because the gear portion 366 and the gear portion on the outer circumferential surface of the second rotating shaft 322 are engaged with each other, when the shaft fixing plate 362 is rotated, the second rotating shaft 322 may be rotated along with the shaft fixing plate 362 without slippage. Although the shaft fixing plate 362 and the boss member 364 are formed as separate parts in FIG. 4, the present embodiment is not necessarily limited thereto, and an example in which the shaft fixing plate 362 and the boss member 364 are integrated with each other may fall within the scope of the present disclosure.

A bushing 370 may be installed above the boss member 364. The second rotating shaft 322 may be inserted into the bushing 370 to penetrate the center of the bushing 370, and first and second bushing gear portions 372 and 374 may be formed on the outer circumferential surface and the inner circumferential surface of the bushing 370. The first bushing gear portion 372 may be gear-engaged with a first bevel gear 380 that will be described below, and the second bushing gear portion 374 may be gear-engaged with the gear portion formed on the outer circumferential surface of the second rotating shaft 322. As such, the bushing 370 may be rotated along with the boss member 364.

The first bevel gear 380 may be located around the outer circumferential surface of the bushing 370. The first bevel gear 380 may be installed to the inner circumferential surface of a lower bearing bracket 385, which is fastened to the lower surface of the bearing housing 330, with a bearing 385*a* interposed therebetween. A gear portion 382 may be formed on the inner circumferential surface of the first bevel gear 380 to be engaged with the first bushing gear portion 372.

The second clutch 320*b* may be located between the bushing 370 and the first bevel gear 380. The second clutch 320*b* may be mounted on the outer circumferential surface of the bushing 370 to slide in the longitudinal direction of the bushing 370 (i.e. the vertical direction in FIG. 4). The second clutch 320*b* may have gear grooves formed in the inner circumferential surface and the outer circumferential surface thereof to be engaged with the first bevel gear 380 and the bushing 370. In FIG. 4, the second clutch 320*b* may be moved downward and may be separated from the first bevel gear 380 and the bushing 370.

An elastic member, such as a coil spring may be installed below the second clutch 320*b*, and may serve to upwardly push the second clutch 320*b*. When no external force is applied to the second clutch 320*b*, the second clutch 320*b* may remain at an upwardly moved position to be kept engaged with the first bevel gear 380 and the bushing 370.

A second bevel gear 300 may be installed above the first bevel gear 380, and may be rotated in a direction opposite to the direction in which the first bevel gear 380 is rotated. The second bevel gear 300 may be rotatably installed around the outer circumferential surface of an upper bearing bracket 302, which may be installed to the lower surface of the bearing housing 330 with a bearing 302*a* interposed therebetween. A pair of third bevel gears 310 may be installed between the first bevel gear 380 and the second bevel gear 300.

The third bevel gears 310 may be rotatably mounted inside the lower bearing bracket 385, and may serve to transmit torque of the first bevel gear 380 to the second bevel gear 300. The first clutch 320*a* may be mounted on the outer circumferential surface of the first rotating shaft 312 to slide in the vertical direction. A sleeve 323 may be integrally formed with the lower portion of the first clutch 320*a* so that the end of the sleeve 323 faces the second clutch 320*b*.

When the first clutch 320*a* is moved downward, the end of the sleeve 322 pushes the top of the second clutch 320*b*, thus causing the second clutch 320*b* to move downward. When the first clutch 320*a* is moved upward, the second clutch 320*b* may return to its initial position by the elasticity of the coil spring installed to the second clutch 320*b*.

A lever groove 324 may be formed above the sleeve 322 so that a lever portion 332 of a clutch lever 331 is inserted into the lever groove 324. The clutch lever 331 serves to move the first clutch 320*a* upward or downward. The clutch lever 331 may move the first clutch 320*a* upward or downward via the operation of an actuator.

An opposite end of the clutch lever 331 may be connected to the actuator. When the opposite end of the clutch lever 331 is moved upward or downward by the actuator, the lever portion 332 may be moved upward or downward about a hinge shaft 334, thus causing the first clutch 320*a* to slide. An arbitrary actuator may be used. For example, a stepping motor may be used in order to keep the clutch lever 331 stationary at an arbitrary point.

A gear portion 326 may be formed on the upper portion of the outer circumferential surface of the first clutch 320*a* and may be engaged with a gear portion 300*a* formed on the inner circumferential surface of the second bevel gear 300. The inner circumferential surface of the first clutch 320*a* opposite the gear portion 326 may be provided with a gear portion, which may be engaged with a gear portion formed on the surface of the first rotating shaft 312.

A coupling groove 328 may be formed on the inner circumferential surface of the first clutch 320*a* at a position close to the sleeve 322. The coupling groove 328 may be coupled to the first bushing gear portion 372 of the bushing 370 when the first clutch 320*a* is moved downward by a given distance or more.

Figure 6:
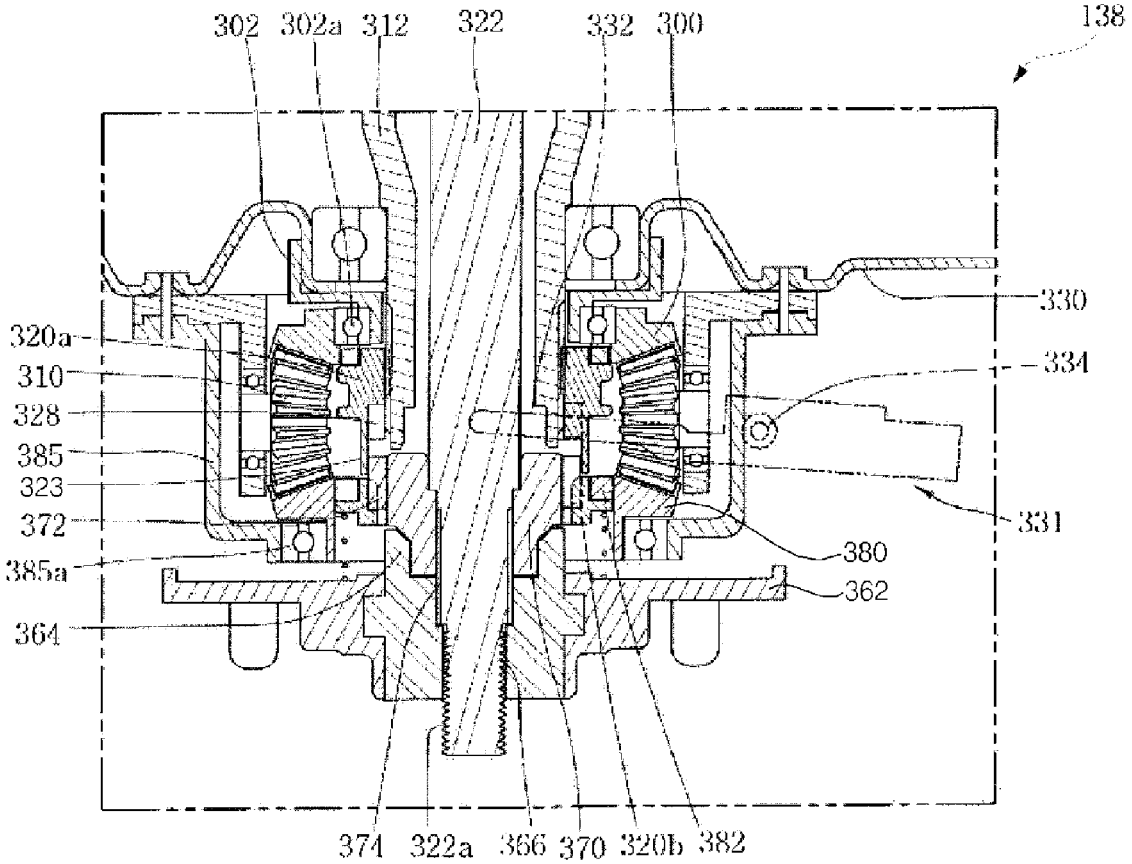
FIGS. 6 and 7 illustrate the operation of first and second clutches of FIG. 3.

As illustrated in FIG. 6, when the first clutch 320*a* is moved to the uppermost position, the first clutch 320*a* may be coupled between the first rotating shaft 312 and the second bevel gear 300. At this time, the second clutch 320*b* may be coupled between the first bevel gear 380 and the bushing 370 by the elasticity of the coil spring.

When the shaft fixing plate 362 is rotated in such a state, torque of the bushing 370 may be transmitted to the first rotating shaft 312 through the second clutch 320*b*, the first bevel gear 380, the third bevel gear 310, the second bevel gear 300, and the first clutch 320*a* in this sequence. Because the first bevel gear 380 and the second bevel gear 300 are rotated in opposite directions, the bushing 370 and the first rotating shaft 312 may be rotated in opposite directions. The bushing 370 may be rotated in the same direction as the second rotating shaft 322. Therefore, the inner tub 122 and the pulsator 133 may be rotated in opposite directions. When the first clutch 320*a* is moved to the uppermost position, the wash tub 120 and the pulsator 133 may be rotated in opposite directions.

Because the inner tub 122 and the pulsator 133 are rotated in opposite directions, the resultant water stream may have the same speed as a speed which would be generated if the pulsator 133 were rotated at double the speed while the wash tub 120 remained stationary, which may result in increased washing performance and reduced washing time. Because a stronger water stream may be acquired than in the case where the wash tub 120 is stationary and only the pulsator 133 is rotated, friction energy with water may be increased and the dissolution of detergent may be increased.

Figure 7:
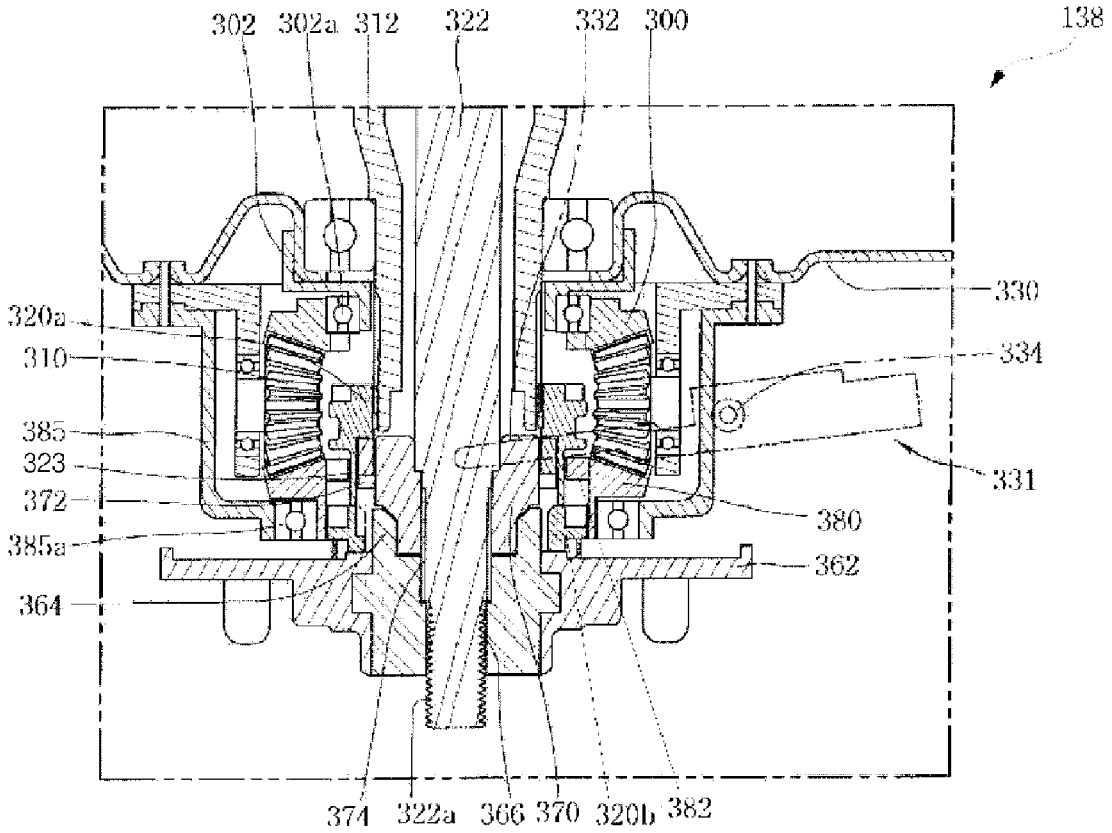

As illustrated in FIG. 7, when the first clutch 320*a* is moved to the lowermost position by the clutch lever 331, the first clutch 320*a* may be separated from the second bevel gear 300 and the coupling groove 328 may be coupled to the first bushing gear portion 372 of the bushing 370. At this time, the second clutch 320*b* may be pushed by the sleeve 322 of the first clutch 320*a* to thereby be moved downward. The second clutch 320*b* may then remain on the outer circumferential surface of the bushing 370 while being separated from the first bevel gear 380.

Because the gear portion and the coupling groove 328 of the first clutch 320*a* are coupled to the first rotating shaft 312 and the bushing 370 respectively, the shaft fixing plate 362, the first clutch 320*a*, and the first rotating shaft 312 may be rotated together. When the first clutch 320*a* is moved to the lowermost position by the clutch lever 331, the wash tub 120 and the pulsator 133 may be rotated together in the same direction.

The torque of the bushing 370 may be directly transmitted to the first rotating shaft 312 through the first clutch 320*a*, and the first to third bevel gears 380, 300 and 310 may be kept stationary without rotation. The first rotating shaft 312 and the second rotating shaft 322 may be rotated in the same direction, and no noise may be generated by the rotation of the first to third bevel gears 380, 300 and 310. In particular, the case where the inner tub 122 and the pulsator 133 are rotated in the same direction corresponds to a dehydration operation in which faster rotation occurs than in a washing operation, and therefore noise reduction may be maximized.

As illustrated in FIG. 4, when the first clutch 320*a* is located at the middle position between the uppermost position and the lowermost position, the first clutch 320*a* may be separated from the second bevel gear 300 and the bushing 370 and may be kept coupled only to the first rotating shaft 312. Because the second clutch 320*b* is pushed by the sleeve 322 to be separated from the first bevel gear 380, the first to third bevel gears 380, 300 and 310 and the second rotating shaft 322 may be stationary without rotation, and only the first rotating shaft 312 may be rotated. When the first clutch 320*a* is located at the middle position between the uppermost position and the lowermost position, only the wash tub 120 is rotated.

The gear ratio of the first to third bevel gears 380, 300 and 310 may be 1:1. When the diameter of the third bevel gear 310 is smaller than a diameter of the first or second bevel gear 380 or 300, the number of revolutions per minute of the third bevel gear 310 may be greater than a number of revolutions of the first or second bevel gear 380 or 300, which may result in decreased power transmission efficiency and increased noise. However, because the vertical length of the drive unit increases as the size of the third bevel gear 310 increases, the amount of space in the cabinet occupied by the third bevel gear 310 increases, which may be problematic. Therefore, the gear ratio may be set as close as possible to 1:1 in view of the limited cabinet size.

Figure 8:
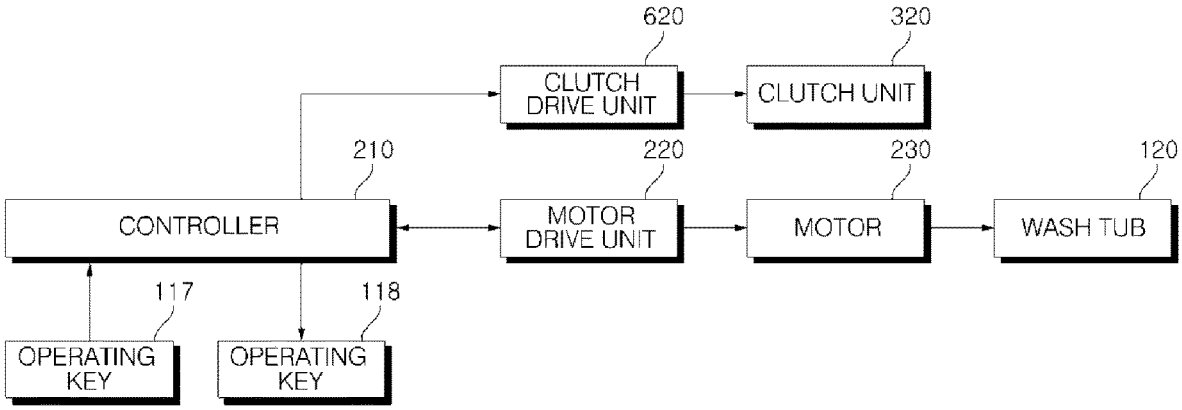
FIG. 8 is a block diagram illustrating the internal configuration of the laundry treatment machine of FIG. 1.

Referring to FIG. 8, in the laundry treatment machine 100, the motor drive unit 220 and the clutch drive unit 620 may be controlled by the control operation of a controller 210. The motor drive unit 220 may drive the motor 230. Thereby, the wash tub 120 may be rotated by the motor 230.

The clutch drive unit 620 may drive a clutch unit (or clutch) 320. The clutch unit 320 may include the first clutch 320*a* and the second clutch 320*b*. As described above, the clutch drive unit 620 may vertically move the first clutch 320*a* included in the clutch unit 320. Specifically, the clutch drive unit 620 may drive the actuator to operate the clutch lever 331, and thus, may move the first clutch 320*a* upward or downward.

When the clutch drive unit 620 moves the first clutch 320*a* to the uppermost position as illustrated in FIG. 6, the inner tub 122 and the pulsator 133 may be rotated in opposite directions. When the clutch drive unit 620 moves the first clutch 320*a* to the lowermost position as illustrated in FIG. 7, the inner tub 122 and the pulsator 133 may be rotated in the same direction. When the clutch drive unit 620 moves the first clutch 320*a* at the middle position between the uppermost position and the lowermost position as illustrated in FIG. 4, only the inner tub 122 among the inner tub 122 and the pulsator 133 may be rotated.

The controller 210 may be operated upon receiving an operation signal from the operating keys 117. Thereby, washing, rinsing, and dehydration operations may be implemented. The controller 210 may also control the display 118 so that the display 118 displays a washing course, a washing time, a dehydration time, a rinsing time, the current state of operation, or the like.

The controller 210 may control the motor drive unit 220, and the motor drive unit 220 may control and operate the motor 230. At this time, no position sensor unit to sense the position of the rotator 230*b* of the motor 230 may be provided inside or outside of the motor 230. The motor drive unit 220 may control the motor 230 in a sensorless manner.

The controller 210 may control the clutch drive unit 620, and the clutch drive unit 620 may drive the clutch unit 320 as described above. The clutch drive unit 620 may move the first clutch 320*a* to the uppermost position, the lowermost position, or the middle position between the uppermost position and the lowermost position. The controller 210 may control the motor 230 such that the motor 230 repeats rotation in a first direction and a stop of the rotation a first number of times and also repeats rotation in a second direction and a stop of the rotation a second number of times during a first time period, after the operation of the clutch unit 320 is changed.

The controller 210 may perform a control operation such that the first number of times and the second number of times are the same. Alternatively, the controller 210 may perform a control operation such that the first number of times is greater than the second number of times.

The controller 210 may perform a control operation during the first time period, such that the magnitude of the rotational speed in the first direction and the magnitude of the rotational speed in the second direction are the same. Alternatively, the controller 210 may perform a control operation during the first time period such that the magnitude of the rotational speed is successively reduced when the motor 230 is rotated in the first direction and then the rotation stops, and such that the magnitude of the rotational speed is successively reduced when the motor 230 is rotated in the second direction and then the rotation stops.

The controller 210 may control the wash tub 120 and the pulsator 133 such that they are rotated together during the first time period as the operation of the clutch unit 320 is changed. The controller 210 may control the motor 230 such that the rotational speed of the motor 230 increases after the first time period, in order to sense the amount of fabric in the wash tub 120.

The motor drive unit 220 may serve to drive the motor 230, and may include an inverter (420 in FIG. 11), an inverter controller (430 in FIG. 11), an output current detector (E in FIG. 11) to detect output current io flowing through the motor 230, and an output voltage detector to detect an output voltage vo applied to the motor 230. The motor drive unit 220 may further include a converter to supply direct current (DC) power to the inverter (420 in FIG. 11).

The inverter controller (430 in FIG. 11) within the motor drive unit 220 may estimate the position of the rotator 230*b* of the motor 230 based on the output current io and the output voltage vo. Then, the motor drive unit 220 may control the motor 230 based on the estimated position of the rotator 230*b* so that the motor 230 is rotated.

When the inverter controller (430 in FIG. 11) generates a switching control signal (Sic in FIG. 11) of a pulse width modulation (PWM) type based on the output current io and the output voltage vo, and outputs the switching control signal to the inverter (430 in FIG. 11), the inverter may perform a high-speed switching operation to supply a prescribed frequency of alternating current (AC) power to the motor 230. Then, the motor 230 may be rotated according to the prescribed frequency of the AC power.

The controller 210 may sense the amount of fabric based on the current io detected by the current detector E. For example, the controller 210 may sense the amount of fabric based on the value of the current io of the motor 230 while the wash tub 120 is rotated.

The controller 210 may sense the eccentricity of the wash tub 120, i.e. the unbalance UB of the wash tub 120. The sensing of eccentricity may be performed based on a ripple component of the current io detected by the current detector E or variation in the rotational speed of the wash tub 120.

Figure 9:
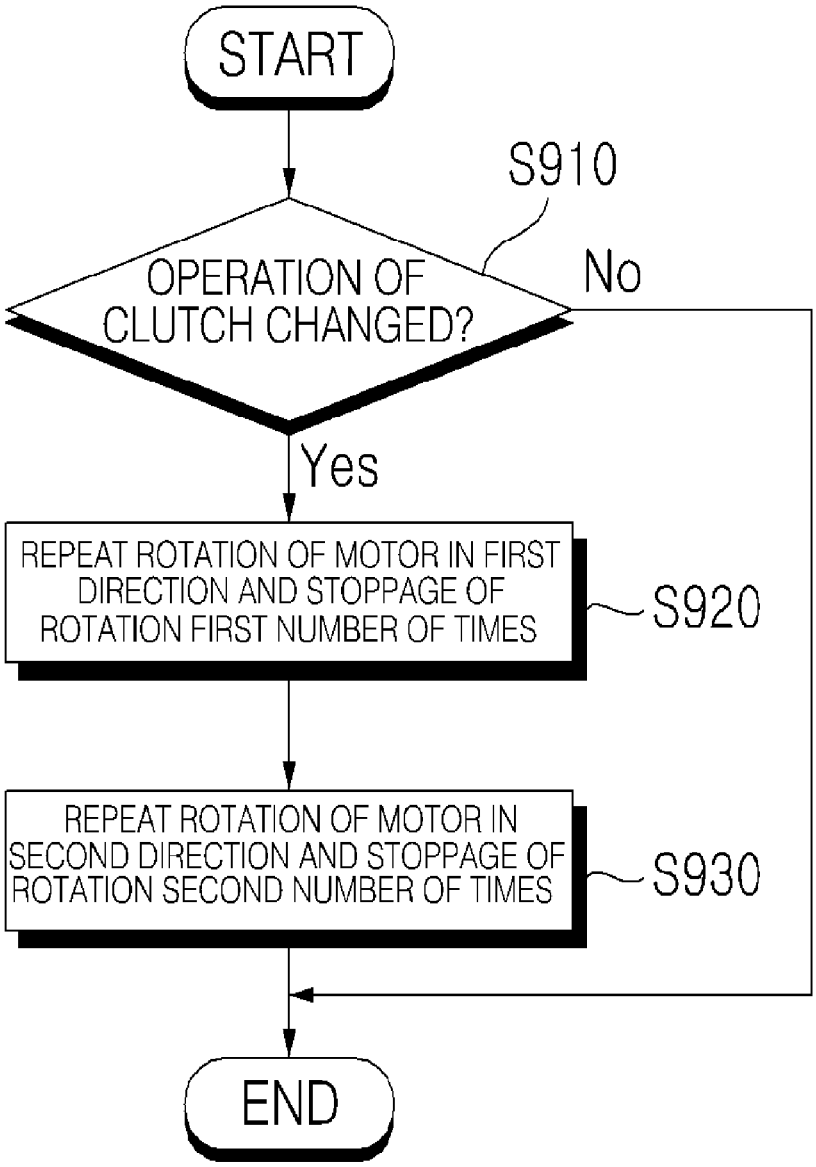
FIG. 9 is a flowchart illustrating an operating method of the laundry treatment machine in accordance with the embodiment.

Referring to FIG. 9, the controller 210 may judge whether or not the operation of the clutch unit 320 is changed (S910). In the case where the laundry treatment machine is a washing machine, the operation of the laundry treatment machine may be divided into a washing operation, a rinsing operation, and a dehydration operation. These operations may be sorted into periods during which both the wash tub 120 and the pulsator 133 are rotated, or periods during which only the wash tub 120 is rotated.

Only the wash tub 120 may be rotated during the dehydration operation, and both the wash tub 120 and the pulsator 133 may be rotated during the rinsing operation and during the washing operation. At some times during the rinsing operation and the washing operation, the wash tub 120 and the pulsator 133 may be rotated in opposite directions in order to approximately double the washing force and rinsing force. Alternatively, at some times during the rinsing operation and the washing operation, the wash tub 120 and the pulsator 133 may be rotated in the same direction.

As described above, in order to rotate both the wash tub 120 and the pulsator 133, the clutch unit 320 may be operated so that the wash tub 120 is connected to the first rotating shaft 312 that is a dehydration shaft and the pulsator 133 is connected to the second rotating shaft 322 that is a washing shaft. In order to rotate only the wash tub 120, the wash tub 120 may be connected to the first rotating shaft 312 and the pulsator 133 may not be connected to the second rotating shaft 322.

When the washing operation or the rinsing operation begins, the controller 210 may control the first clutch 320*a* so that the first clutch 320*a* is moved to the lowermost position as illustrated in FIG. 7. The controller 210 may control the clutch drive unit 620 to couple the wash tub 120 and the pulsator 133 to each other so that torque of the motor 230 is transmitted to both the wash tub 120 and the pulsator 133 when the washing operation or the rinsing operation begins.

In the related art, the motor 230 may repeat forward rotation and reverse rotation has been adopted in order to increase the coupling force required to couple the wash tub 120 and the pulsator 133 to each other when a clutch is driven. With this scheme, due to the difference in speed between the forward rotation and the reverse rotation, noise is generated and damage to the clutch often occurs. In particular, when the forward rotation and the reverse rotation are not performed at suitable rotation angles, the success rate at which the clutch accomplishes the coupling thereof is disadvantageously reduced.

In order to solve the problem described above, the motor 230 may be controlled to repeat rotation and braking, in the first direction the first number of times and to repeat rotation in the second direction the second number of times during the first time period after the operation of the clutch unit 320 is changed. In Step 910 (S910), when the first clutch 320*a* is moved to the middle position between the uppermost position and the lowermost position as illustrated in FIG. 4, the controller 210 controls the motor 230 to repeat rotation and braking in the first direction the first number of times (S920), and to repeat rotation and braking in the second direction the second number of times (S930) during the first time period.

Figure 10A:
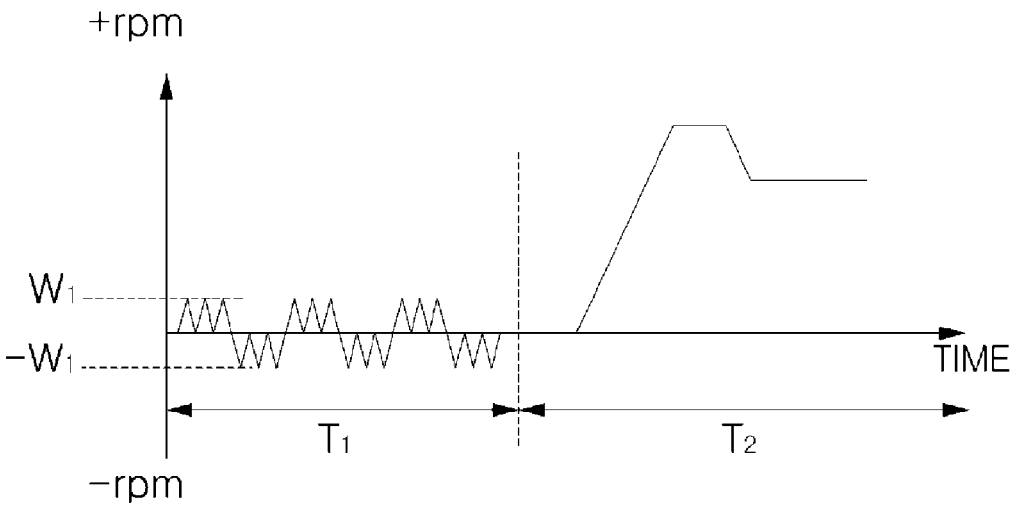
FIGS. 10A and 10B are views referenced to explain the operating method of FIG. 9.

Referring to FIG. 10A, in order to increase the coupling force of the clutch unit 320 when the operation of the clutch unit 320 is changed, the controller 210 may control the motor 230 to repeat rotation and braking in the first direction the first number of times during the first time period $T_1$ during a shaking time period. In the case where rotation and braking in the first direction are repeated multiple times within a short time, it may not be necessary to repeat forward rotation and reverse rotation as in the related art, and therefore the generation of noise may be reduced and the likelihood of damage to the clutch may be reduced. In addition, by repeating rotation and braking in the first direction multiple times within a short time, the degree of risk of damage to the clutch may be reduced and the success rate of coupling may be increased.

The controller 210 may control the motor 230 to repeat rotation and braking in the second direction the second number of times, after repeating rotation and braking in the first direction the first number of times. FIG. 10A illustrates that rotation and braking in the first direction at a first speed ($W_1$) are repeated three times, and rotation and braking in the second direction, opposite the first direction, at a second speed ($-W_1$) are repeated three times.

Although FIG. 10A illustrates that the number of repetitions of rotation and braking in the first direction is 3 and the number of repetitions of rotation and braking in the second direction is 3, alterations thereof are possible. For example, the controller 210 may perform a control operation such that rotation and braking in the second direction are repeated the second number of times, which is smaller than the first number of times, because the possibility of coupling is increased by the first number of repetitions of rotation and braking in the first direction. The motor 230 may repeat rotation and braking in the second direction at the second speed ($-W_1$) two times.

Although FIG. 10A illustrates that the magnitude of the first rotational speed $W_1$ in the first direction and the magnitude of the second rotational speed $-W_1$ in the second direction during the first time period T1 are the same, alterations thereof are possible. The motor 230 may rotate at a speed $W_a$, stop, rotate at a speed $W_b$, stop, rotate at a speed $W_c$, and stop in the first direction. The motor may then rotate at a speed $-W_a$, stop, rotate at a speed $-W_b$, stop, rotate at a speed $-W_c$, and stop in the second direction during the first time period T1. The magnitude of the rotational speed may be in the order of Wa>Wb>Wc.

Because the possibility of coupling is the highest upon initial rotation and stop of the rotation, the rotational speed of the motor 230 may be set to a lower value upon subsequent rotation and stop of the rotation. The rotational speed or the rotational angle may be set to be successively reduced. Thus, the consumption of power of the motor 230 during the shaking time period may be reduced.

Figure 10B:
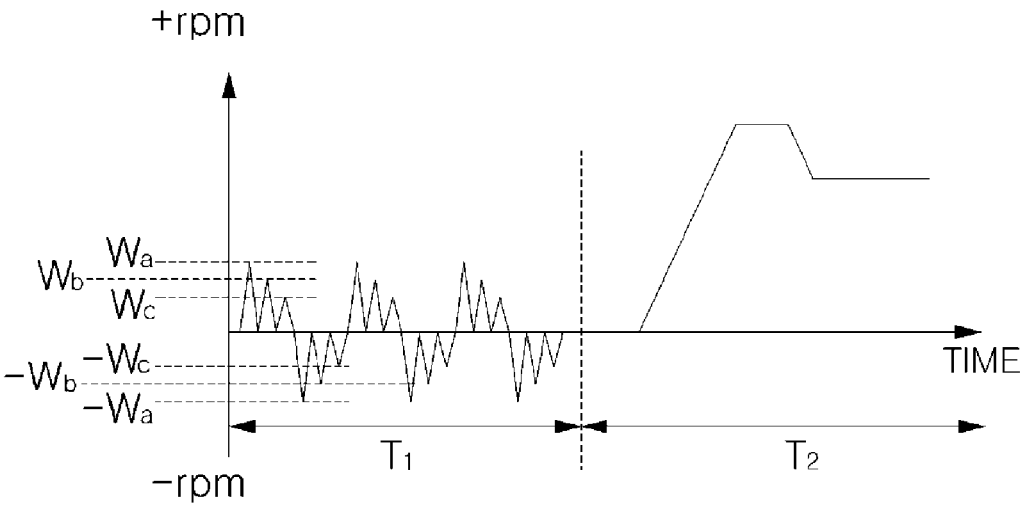

In FIGS. 10A and 10B, because the coupling is completed after the first time period $T_1$ depending on change in the operation of the clutch unit 320, sensing of the amount of fabric may be performed to determine the amount of fabric in the wash tub 120. The controller 210 may thus control the motor 230 so that the rotational speed of the motor 230 is increased.

As described above, by setting the shaking time period $T_1$ when the operation of the clutch unit 320 is changed, and controlling the motor 230 to be rotated and braked in the first direction the first number of times during the first time period $T_1$, the coupling force may be increased and noise from the clutch unit 320 and the likelihood of damage to the clutch unit 320 may be reduced. The controller 210 may control the motor drive unit 220 to drive the motor 230 during the first time period $T_1$ and the second time period $T_2$. The operation of the motor drive unit 220 will be described below with reference to FIGS. 11 and 12.

Figure 11:
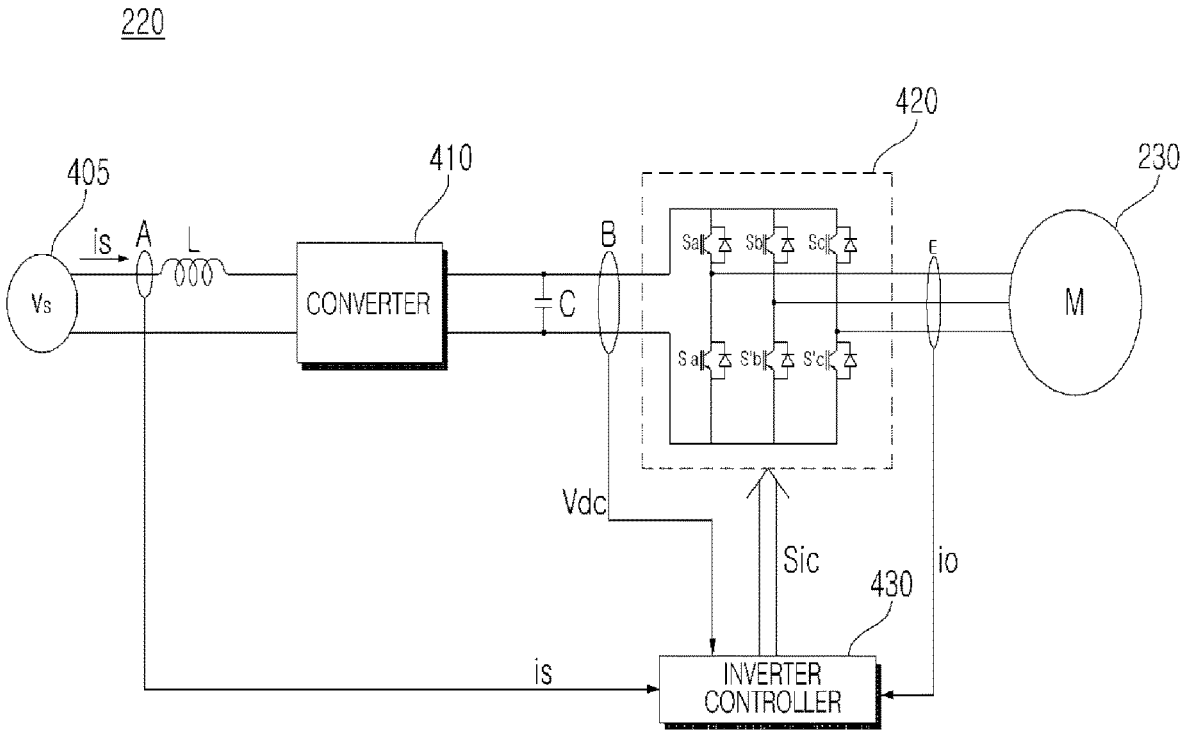
FIG. 11 is a circuit diagram of the internal configuration of a motor drive unit of FIG. 8.

Referring to FIG. 11, the motor drive unit 220 may serve to drive the sensorless type motor 230, and may include a converter 410, an inverter 420, an inverter controller 430, a DC terminal voltage detector B, a smoothing capacitor C, and an output current detector E. The motor drive unit 220 may further include an input current detector A and a reactor L.

The reactor L may be located between a commercial AC power source 405 ($V_s$) and the converter 410, and may perform power factor correction or boosting. In addition, the reactor L may perform the function of limiting harmonic current caused by the high-speed switching of the converter 410.

The input current detector A may detect a current is input from the commercial AC power source 405. A Current Transformer (CT) or a shunt resistor may be used as the input current detector A. The detected input current is is a discrete signal in a pulse form, and may be input to the inverter controller 430.

The converter 410 may convert commercial AC power, which has been supplied from the commercial AC power source 405 and has passed through the reactor L, into DC power to output the DC power. Although FIG. 11 illustrates the commercial AC power source 405 as a single-phase AC power source, the commercial AC power source 405 may be a three-phase AC power source. The internal configuration of the converter 410 may be changed according to the kind of the commercial AC power source 405.

The converter 410 may include diodes without switching elements, and may perform rectification without switching. Four diodes may be used in a bridge form in the case where a single-phase AC power source is used, and six diodes may be used in a bridge form in the case where a three-phase AC power source is used.

The converter 410 may be a half bridge type converter in which two switching elements and four diodes are connected to one another. In the case where a three-phase AC power source is used, the converter 410 may include six switching elements and six diodes. When the converter 410 includes a switching element, boosting, power factor improvement, and conversion into DC power may be performed via operation of the switching element.

The smoothing capacitor C may perform smoothing of input power and store the power. Although FIG. 11 illustrates a single smoothing capacitor C, a plurality of smoothing capacitors may be provided to achieve increased capacitor stability.

Although FIG. 11 illustrates the smoothing capacitor C as being connected to the output terminal of the converter 410, the embodiment is not limited thereto, and DC power may be directly input to the smoothing capacitor C. For example, DC power from a solar cell may be directly input to the smoothing capacitor C, or may subjected to DC/DC conversion prior to being input to the smoothing capacitor C. The following description is based on the illustration of FIG. 11.

Opposite terminals of the smoothing capacitor C may store DC power, and therefore may be referred to as DC terminals or DC link terminals. The DC terminal voltage detector B may detect a DC terminal voltage Vdc at opposite terminals of the smoothing capacitor C. The DC terminal voltage detector B may include a resistor and an amplifier. The detected DC terminal voltage Vdc may be a discrete signal in a pulse form, and may be input to the inverter controller 430.

The inverter 420 may include a plurality of inverter switching elements, and may convert the DC power Vdc, which has been smoothened by the on/off operations of the switching elements, into three-phase AC power va, vb and vc of a prescribed frequency, and may output the same to the three-phase synchronous motor 230. In the inverter 420, an upper arm switching element Sa, Sb or Sc and a lower arm switching element S'a, S'b or S'c, which are connected to each other in series, may be paired, and a total of three pairs of upper arm and lower arm switching elements Sa and S'a, Sb and S'b, and Sc and S'c may be connected in parallel. Diodes may be connected in inverse parallel to the respective switching elements Sa, S'a, Sb, S'b, Sc and S'c.

The respective switching elements in the inverter 420 may be turned on or off based on an inverter switching control signal Sic from the inverter controller 430. Thereby, three-phase AC power having a prescribed frequency may be output to the three-phase synchronous motor 230.

The inverter controller 430 may control the switching operation of the inverter 420 in a sensorless manner. The inverter controller 430 may receive output current io detected by the output current detector E and an output voltage vo detected by the output voltage detector.

The inverter controller 430 may output the inverter switching control signal Sic to the inverter 420 in order to control the switching operation of the inverter 420. The inverter switching control signal Sic may be a switching control signal of a Pulse Width Modulation (PWM) type, and may be generated and output based on the output current io detected by the output current detector E and the output voltage vo detected by the output voltage detector. A detailed operation with regard to the output of the inverter switching control signal Sic in the inverter controller 430 will be described below in more detail with reference to FIG. 12.

The output current detector E may serve to detect output current io flowing between the inverter 420 and the three-phase synchronous motor 230. The output current detector E may detect current flowing to the motor 230. The output current detector E may detect all phases of output current ia, ib and ic, or may detect two phases of output current using three-phase equilibrium. The output current detector E may be located between the inverter 420 and the motor 230, and a Current Transformer (CT) or a shunt resistor may be used to detect current.

When a shunt resistor is used, three shunt resistors may be located between the inverter 420 and the synchronous motor 230, or may be connected at one end thereof to the three lower arm switching elements S'a, S'b and S'c of the inverter 420 respectively. Two shunt resistors may be used based on the use of three-phase equilibrium. When a single shunt resistor is used, the shunt resistor may be located between the capacitor C, which was described above, and the inverter 420.

The detected output current io may be a discrete signal in a pulse form, and may be applied to the inverter controller 430. The inverter switching control signal Sic may be generated based on the detected output current io. The detected output current io may also be described as being three-phase output current ia, ib and ic.

The output voltage detector may be located between the inverter 420 and the motor 230, and may serve to detect an output voltage applied from the inverter 420 to the motor 230. When the inverter 420 is operated by a switching control signal based on pulse width modulation (PWM), the output voltage may be a pulse-shaped voltage based on pulse width modulation (PWM).

In order to detect the pulse-shaped voltage based on pulse width modulation (PWM), the output voltage detector may include a resistor element, which may be electrically connected between the inverter 420 and the motor 230, and a comparator, which may be connected to one end of the resistor element.

The detected output voltage vo based on pulse width modulation may be a discrete signal in a pulse form and may be applied to the inverter controller 430. The inverter switching control signal Sic may be generated based on the detected output voltage vo. The detected output voltage vo may also be described as being three-phase output voltages va, vb and vc.

Meanwhile, the three-phase synchronous motor 230 may include a stator and a rotator. The rotator may be rotated when respective phases of AC power having a prescribed frequency are applied to stator coils of respective phases a, b and c. The motor 230 may be, for example, a Surface Mounted Permanent Magnet Synchronous motor (SMPMSM), an Interior Permanent Magnet Synchronous Motor (IPMSM), or a Synchronous Reluctance Motor (Synrm). Among these, the SMPMSM and the IPMSM are permanent magnet synchronous motors (PMSMs), and the Synrm has no permanent magnet.

When the converter 410 includes a switching element, the inverter controller 430 may control the switching operation of the switching element in the converter 410. The inverter controller 430 may receive input current is detected by the input current detector A. In addition, the inverter controller 430 may output a converter switching control signal Scc to the converter 410 in order to control the switching operation of the converter 410. The converter switching control signal Scc may be a switching control signal of a pulse width modulation (PWM) type, and may be generated and output based on the input current is detected by the input current detector A.

Figure 12:
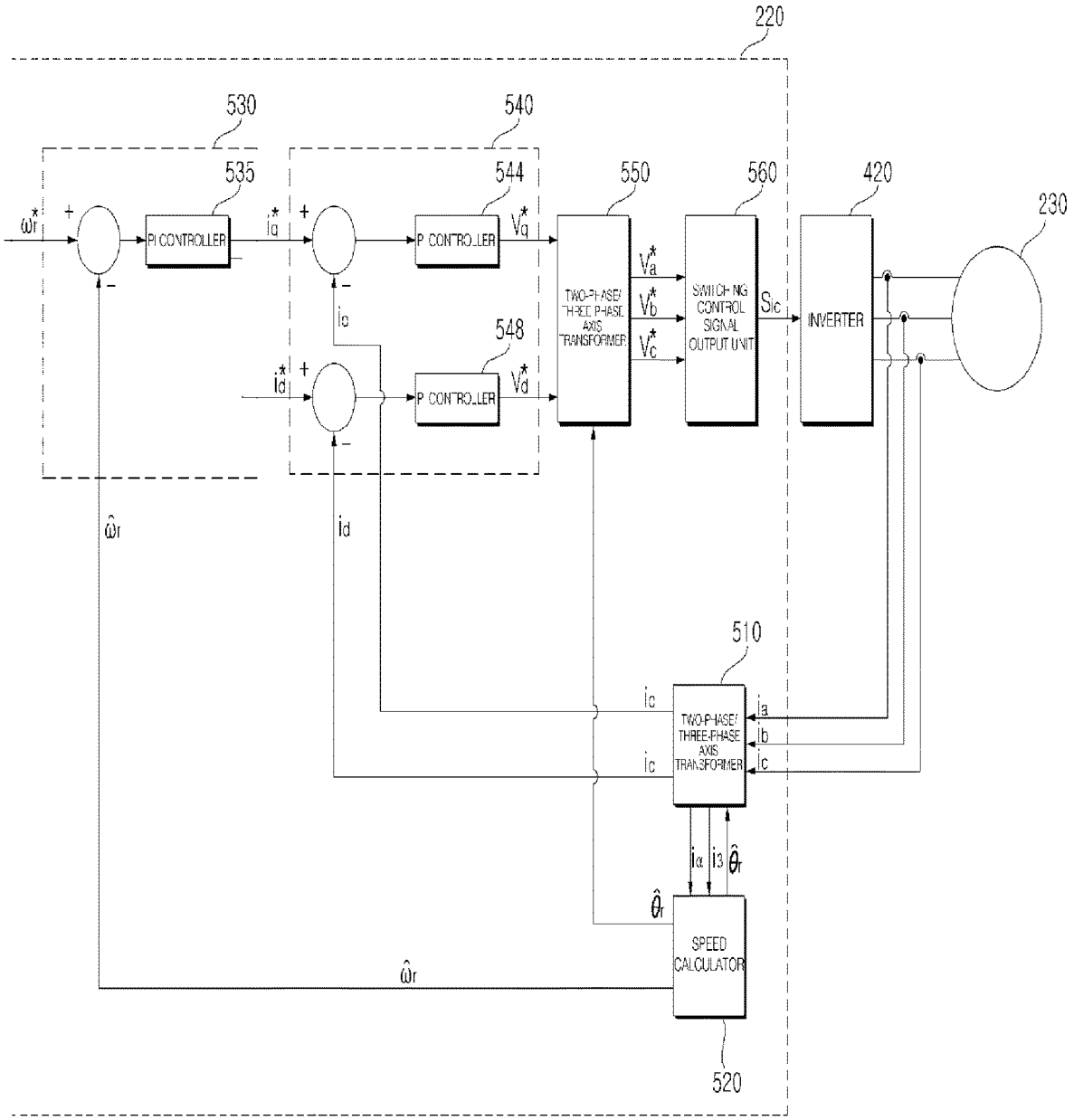
FIG. 12 is a circuit diagram of the internal configuration of an inverter controller of FIG. 11.

Referring to FIG. 12, the inverter controller 430 may include an axis transformer 510, a speed calculator 520, a current reference generator 530, a voltage reference generator 540, an axis transformer 550, and a switching control signal output unit or device 560. The axis transformer 510 may receive the output current $i_a$, $i_b$ and $i_c$ detected by the output current detector E, and transform the output current $i_a$, $i_b$ and $i_c$ into two-phase current $i_\alpha$ and $i_\beta$ of a fixed coordinate system and two-phase current $i_d$ and $i_q$ of a rotating coordinate system.

The axis transformer 510 may output the transformed two-phase current $i_s$ and $i_s$ of the fixed coordinate system and two-phase voltages $v_\alpha$ and $v_\beta$ of the fixed coordinate system and the transformed two-phase current $i_d$ and $i_q$ of the rotating coordinate system and two-phases voltage $v_d$ and $v_q$ of the rotating coordinate system. The speed calculator 520 may calculate the position θ and speed w of the rotator of the motor 230 upon receiving the axis-transformed two-phase current $i_\alpha$ and $i_\beta$ of the fixed coordinate system and the axis-transformed two-phase voltages $v_\alpha$ and $v_\beta$ of the fixed coordinate system.

The current reference generator 530 may generate a current reference $i^*_q$ based on the calculated speed $\hat{\omega}_r$ and a speed reference $\omega^*_r$. The current reference generator 530 may perform PI control in a PI controller 535 based on the difference between the calculated speed $\hat{\omega}_r$ and the speed reference $\omega^*_r$, and may generate the current reference $i^*_q$. Although FIG. 12 illustrates a q-axis current reference $i^*_q$ as the current reference, alternatively, a d-axis current reference $i^*_d$ may be concurrently generated. The value of the d-axis current reference $i^*_d$ may be set to zero. The current reference generator 530 may further include a limiter, which limits the level of the current reference $i^*_q$ to prevent the current reference $i^*_q$ from exceeding a tolerance range.

The voltage reference generator 540 may then generate d-axis and q-axis voltage references $v^*_d$ and $v^*_q$ based on the d-axis and q-axis current $i_d$ and $i_q$, which have been axis-transformed to a two-phase rotating coordinate system in the axis-transformer 510, and the current references $i^*_d$ and $i^*_q$ from, for example, the current reference generator 530. The voltage reference generator 540 may perform PI control in a PI controller 544 based on the difference between the q-axis current $i_q$ and the q-axis current reference $i^*_q$, and may generate the q-axis voltage reference $v^*_q$. In addition, the voltage reference generator 540 may perform PI control in a PI controller 548 based on the difference between the d-axis current $i_d$ and the d-axis current reference $i^*_d$, and may generate the d-axis voltage reference $v^*_d$. The value of the d-axis voltage reference $v^*_d$ may be set to zero to correspond to the case where the d-axis current reference $i^*_d$ is set to zero.

The voltage reference generator 540 may further include a limiter, which limits the level of the d-axis and q-axis voltage references $v^*_d$ and $v^*_q$ to prevent the d-axis and q-axis voltage references $v^*_d$ and $v^*_q$ from exceeding a tolerance range. The generated d-axis and q-axis voltage references $v^*_d$ and $v^*_q$ may be input to the axis transformer 550.

The axis transformer 550 may perform axis transformation upon receiving the calculated position $\hat{\theta}_r$ from the speed calculator 520 and the d-axis and q-axis voltage references $v^*_d$ and $v^*_q$. The axis transformer 550 may first perform transformation from a two-phase rotating coordinate system to a two-phase fixed coordinate system. The calculated position $\hat{\theta}_r$ from the speed calculator 520 may be used.

The axis transformer 550 may then perform transformation from the two-phase fixed coordinate system to a three-phase fixed coordinate system. With this transformation, the axis transformer 550 may output three-phase output voltage references $v^*_a$, $v^*_b$ and $v^*_c$.

The switching control signal output unit 560 may generate and output the inverter switching control signal Sic of a pulse width modulation (PWM) type based on the three-phase output voltage references $v^*_a$, $v^*_b$ and $v^*_c$.

The output inverter switching control signal Sic may be converted into a gate drive signal in a gate drive unit, and may be input to the gate of each switching element in the inverter 420. The respective switching elements Sa, S'a, Sb, S'b, Sc and S'c within the inverter 420 may perform switching operation.

The laundry treatment machine is not limited to the configuration and method of the embodiments described above, and some or all of the embodiments may be selectively combined to achieve various alterations of the embodiments. Meanwhile, a method of operating the laundry treatment machine may be implemented as a code that may be written on a processor readable recording medium and thus read by a processor provided in the laundry treatment machine. The processor readable recording medium may be any type of recording device in which data is stored in a processor readable manner.

A laundry treatment machine may include a wash tub, a pulsator rotatably provided inside the wash tub, a motor to rotate at least one of the wash tub and the pulsator, a clutch unit to selectively transmit torque of the motor to at least one of the wash tub and the pulsator, a clutch drive unit to control driving of the clutch unit, and a controller to control the motor to repeat rotation in a first direction and stop of the rotation a first number of times during a first time period after operation of the clutch unit is changed, thereby achieving increased coupling force of the clutch unit when operation of the clutch unit is changed. In addition, it is possible to reduce the risk of damage to the clutch unit.

The controller may control the motor to repeat rotation in a second direction and stop of the rotation a second number of times, after the rotation in the first direction, which may further increase the coupling force when operation of the clutch unit is changed. In addition, it is possible to reduce the risk of damage to the clutch unit.

A top-loading type laundry treatment machine may be capable of increasing the coupling force of a clutch unit when the operation of the clutch unit is changed.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treatment machine comprising:

a wash tub;

a pulsator rotatably provided inside the wash tub;

a motor to rotate at least one of the wash tub and the pulsator;

at least one clutch to selectively transmit torque of the motor to at least one of the wash tub and the pulsator;

a motor driver to control driving of the motor;

a clutch driver to control driving of the at least one clutch; and a controller electrically connected to the motor driver to control the motor driver and the clutch driver to control the clutch driver, wherein the controller is configured to control the motor to repeat rotation and braking in a first direction a first number of times during a first period after a position of the at least one clutch is selected, wherein the controller controls the motor to repeat rotation and braking in a second direction a second number of times during a second period, subsequent to the first period, wherein a magnitude of a rotational speed and rotational angle are successively reduced when the motor is rotated and braked in the first direction during the first period, and a magnitude of a rotational speed and rotational angle are successively reduced when the motor is rotated and braked in the second direction during the second period, and wherein changing the speed of the motor from speed in the first direction to speed in the second direction is performed without stopping the motor between the first period and the second period, wherein during a third period subsequent to the second period, the controller is configured to increase the rotational speed of the motor to a first speed, to sustain the first speed, and to decrease the rotational speed of the motor from the first speed to a second speed in order to sense amount of fabric in the wash tub, wherein the first speed of the third period is greater than the rotational speed during the first period and the second period.

2. The laundry treatment machine according to claim 1, wherein the first number of times and the second number of times are the same.

3. The laundry treatment machine according to claim 1, wherein the first number of times is greater than the second number of times.

4. The laundry treatment machine according to claim 1, wherein a magnitude of a rotational speed in the first direction and a magnitude of a rotational speed in the second direction during the first time period are the same.

5. The laundry treatment machine according to claim 1, wherein the at least one clutch includes:

a first clutch to be coupled to a first rotating shaft to be rotated along with the first rotating shaft; and a second clutch to be coupled to a second rotating shaft to be rotated along with the second rotating shaft.

6. The laundry treatment machine according to claim 5, wherein the first clutch is moved to an uppermost position toward the wash tub to allow the wash tub and the pulsator to be rotated in opposite directions.

7. The laundry treatment machine according to claim 5, wherein the first clutch is moved to a lowermost position away from the wash tub to allow the wash tub and the pulsator to be rotated in the same direction.

8. The laundry treatment machine according to claim 5, wherein the first clutch is located between an uppermost position toward the wash tub and a lowermost position away from the wash tub to allow only the wash tub, among the wash tub and the pulsator, to be rotated.

9. The laundry treatment machine according to claim 5, further including:

a first bevel gear, which is selectively coupled to the second clutch; and a second bevel gear, which is selectively coupled to the first clutch, the second bevel gear being rotated in a direction opposite a direction in which the first bevel gear is rotated, wherein the second clutch is engaged with the first bevel gear when the first clutch and the second bevel gear are engaged with each other, and is moved by the first clutch and is separated from the first bevel gear when the first clutch is moved to the second clutch by a prescribed distance or more, and the first clutch is coupled to the first and second rotating shafts at the same time.

10. The laundry treatment machine according to claim 9, further including a third bevel gear engaged with the respective first and second bevel gears, the third bevel gear serving to transmit a torque of the first bevel gear to the second bevel gear.

11. The laundry treatment machine according to claim 9, wherein the first clutch has a push portion formed at a lower surface thereof to push the second clutch downward along the second rotating shaft.

12. The laundry treatment machine according to claim 9, wherein the first clutch is gear-engaged with outer circumferential surfaces of the first and second rotating shafts at an inner circumferential surface.

13. The laundry treatment machine according to claim 12, wherein the outer circumferential surface of the second rotating shaft and the inner circumferential surface of the first clutch are gear-engaged with each other.

14. The laundry treatment machine according to claim 9, wherein the first clutch is gear-engaged with an inner circumferential surface of the second bevel gear at an outer circumferential surface of an upper portion of the first clutch.

15. The laundry treatment machine according to claim 9, wherein, when the first clutch is moved to the second clutch within a prescribed distance, the second clutch is moved by the first clutch to be separated from the first bevel gear, and the first clutch is coupled only to the first rotating shaft.

16. The laundry treatment machine according to claim 9, wherein the first bevel gear is gear-engaged with an outer circumferential surface of the second clutch at an inner circumferential surface of the first bevel gear.

17. The laundry treatment machine according to claim 1, wherein the motor driver includes:

an inverter to convert direct current (DC) power into alternating current (AC) power to output the AC power to the motor; and an inverter controller to control the inverter to drive the motor based on an output voltage detected from an output voltage detector located between the inverter and the motor, wherein the inverter controller is configured to:

estimate a position of a rotator of the motor and a speed of the motor based on an output current from an output current detector configured to detect the output current flowing in the motor;

generate a current reference based on the estimated speed and a speed reference value;

generate a voltage reference value based on the current reference and the detected output current; and output a switching control signal required to drive the inverter based on the voltage reference value.

* * * * *